United States Patent [19]

Lewis

[11] Patent Number: 4,580,687

[45] Date of Patent: Apr. 8, 1986

[54] LOW PROFILE DISPENSING CAP

[76] Inventor: Duane H. Lewis, P.O. Box 481, Claysville, Pa. 15323

[21] Appl. No.: 687,972

[22] Filed: Dec. 31, 1984

[51] Int. Cl.[4] ..... B65D 47/08

[52] U.S. Cl. ..... 215/237; 220/254; 220/339; 222/485; 222/556

[58] Field of Search ..... 215/235, 237, 245; 220/254, 339; 222/485, 556, 480

[56] References Cited

U.S. PATENT DOCUMENTS

| | | | |
|---|---|---|---|
| D. 276,981 | 1/1985 | Cleevely | D9/449 |
| 3,018,931 | 1/1962 | Westgate | 222/480 |
| 3,255,928 | 6/1966 | Foster | 215/237 |
| 3,323,671 | 6/1967 | Minarik et al. | 215/237 |
| 4,361,250 | 11/1982 | Foster | 220/254 X |
| 4,457,458 | 7/1984 | Heinol | 215/235 X |
| 4,494,679 | 1/1985 | Cleevely | 222/151 |

*Primary Examiner*—Donald F. Norton

*Attorney, Agent, or Firm*—Charles W. Fallow; Martin P. Hoffman; Mitchell B. Wasson

[57] ABSTRACT

A plastic dispenser cap has a closure, integrally attached thereto by a continuous hinge, for blocking holes formed in the cap. When shut, the lower surface of the closure is flush with the upper surface of the cap, resulting in an article of minimal height. When assembled to standard bottles, a stackable assembly results.

4 Claims, 5 Drawing Figures

FIG. 1
PRIOR ART
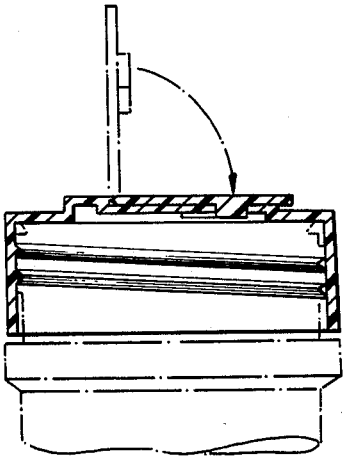
FIG. 2
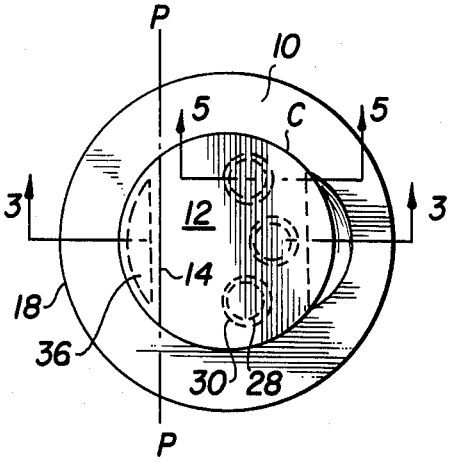
FIG. 3
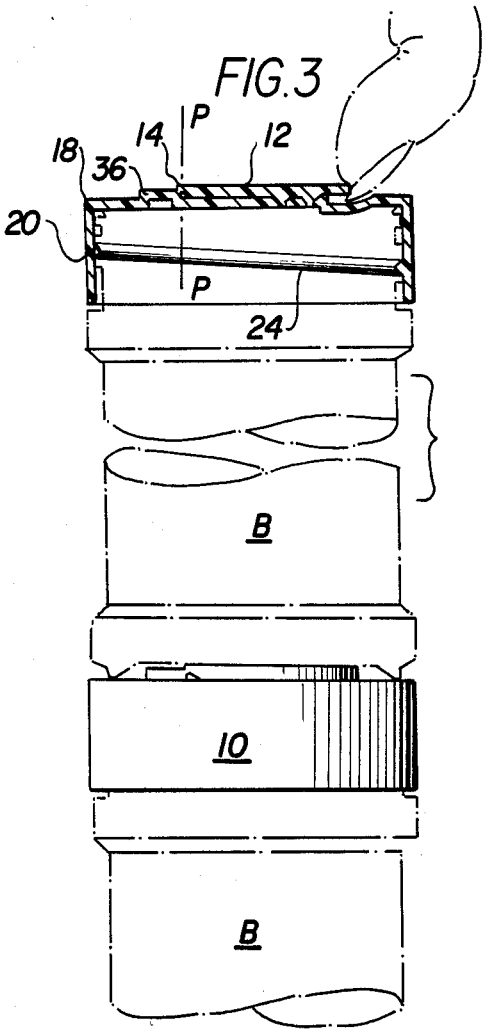
FIG. 4
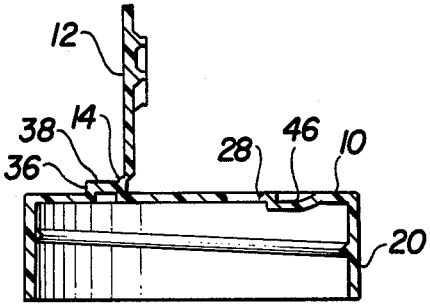
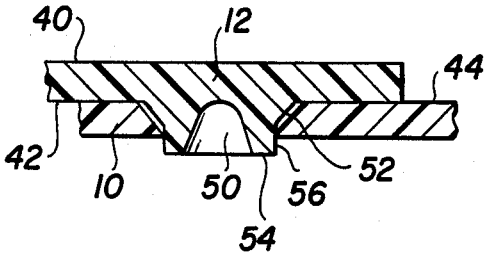
FIG. 5

LOW PROFILE DISPENSING CAP

BACKGROUND OF THE INVENTION (1) Field of the Invention

This invention relates to caps for bottles or jars, particularly to a cap having holes therein for dispensing powders or the like, and having an integral closure, for blocking the holes when not in use.

(2) Prior Art

There are numerous known plastic container caps having holes therein for dispensing powders, crystalline substances, flakes and other fluent materials, many such caps having closures for selectively blocking the holes. One known prior art cap, manufactured by C. F. Sauer Company, has a top surface provided with a raised circular platform to which a closure is attached by means of a continuous "living" hinge. The raised platform design may contribute to cap strength; it also enables one to get a fingernail or implement under the closure in order to open it. It has been found, however, that generic plastic bottles with the described prior caps assembled thereon do not stack properly. The cap's raised platform and closure are taller than the bottom depression of a standard bottle, so that the outer peripheries of the cap and the next higher bottle bottom cannot touch. Rather, contact is primarily between the cap closure and the bottom of the next higher bottle, resulting in undesirable instability. The manufacturer therefore produces a special bottle for this cap characterized by a deeper than usual depression in its bottom. Special manufacturing techniques are required to form a deep depression—the molding die may for example require a moving bottom plug, at an increased cost of over five thousand dollars per mold.

Thus, it is a primary object of this invention to provide the industry with a dispensing cap which, when applied to generic plastic bottles, results in an assembly capable of being stacked safely.

Another object is to reduce the total price of a bottle-and-cap assembly by providing a cap useable on inexpensive, generic bottles.

These objects are satisfied by a plastic cap having dispensing holes therein and a closure for covering the holes, the closure being connected to the cap by means of a continuous hinge integral with the cap and the closure, characterized in that the bottom surface of the closure is coplanar with the upper surface of the cap when the closure is shut. With a cap thickness of about 0.060 inch, the top of the cap lies well below the bottom depression in the next higher bottle in a stack.

Another advantage of the invention incident to this new construction is that somewhat less material is required in manufacturing the cap, with resultant cost savings.

BRIEF DESCRIPTION OF THE DRAWINGS

In the drawing,

FIG. 1 shows a sectional view of the prior art cap described above;

FIG. 2 is a plan view of a cap embodying the present invention;

FIG. 3 is a sectional view taken along the axial plane 3—3 in FIG. 2, showing the cap closure shut;

FIG. 4 is a sectional view corresponding to FIG. 3, showing the cap closure open; and FIG. 5 is an enlarged sectional view taken along the line 5—5 in FIG. 2.

DESCRIPTION OF THE PREFERRED EMBODIMENT

As shown in FIGS. 2–4, a device embodying the invention includes a cap 10 with a closure 12 connected thereto. The cap and closure are integrally injection molded from a flexible plastic material, preferably polypropylene, and are interconnected by a continuous "living" hinge 14. Polypropylene is particularly suited for hinges of this type because it can be flexed repeatedly without breaking.

The cap is bounded by a periphery 18, from which a skirt 20 extends downwardly. The inner diameter of the skirt conforms to the generic bottle B for which it is designed, and has interlocking means such as molded threads 24 thereon. The central portion of the cap has one or more (three being shown in the drawing) holes 28 therethrough, each of which is chamfered at 30.

As FIG. 2 shows, the periphery of closure 12 is a major arc of a circle C, and the hinge 14 extends along a chord interconnecting the ends of the arc. The minor arc of this circle defines, with the hinge 14, a raised pedestal 36 in the shape of a circular segment. The pedestal has an upper surface 38 slightly lower than the upper surface 40 of closure 12 so that the hinge 14, which extends within a vertical plane P, may be adequately flexible.

In FIG. 5, the closure's bottom surface 42, it should be noted, is coplanar with the top surface 44 of the cap thus minimizing the total height of the device.

To facilitate opening the closure, the cap is provided with a depression 46 (FIG. 3) beneath the periphery of the closure opposite the hinge 14, this depression being approximately 0.060 inch deep and suitably shaped for the insertion of a thumbnail.

Three plugs 50 extend downwardly from the closure's bottom surface 42 at locations corresponding to the holes 28 in the cap. Each plug, one of which is shown in detail in FIG. 5, has a conical base 52 and a cylindrical tip 54 sized to fit closely within its respective hole 28. The tip of each outer plug has a small tang 56 thereon to retain the tip within its hole and to provide the closure with a positive snap action when opened or closed.

To use, the cap, secured upon a standard bottle, is opened by inserting a thumbnail or the like into depression 46, and material within the bottle is poured or shaken out through the holes 28. Following use, as the closure is shut, the chamfers 30 guide the plug tips 54 into their holes, where they are retained by tangs 56.

As FIG. 3 shows, generic bottles bearing the inventive cap may be stacked one on another safely, since there is only peripheral contact at P in FIG. 3, and an absence of contact against the closure 12 or pedestal 36.

Inasmuch as the invention is subject to variations and modifications, the foregoing description of the presently preferred embodiment should be regarded as only illustrative of the invention. For example, any number of pouring holes may be provided, according to the intended application. The tangs may be modified or replaced by some other closure fastening means, and the geometry of the plugs or the cap may be varied within the scope of the following claims.

I claim:

1. A plastic dispenser for a bottle, comprising a cap having a plurality of throughholes for dispensing fluent material, a skirt extending downwardly from said cap, a closure for sealing said holes, a continuous hinge interconnecting said cap and said closure and being integral with both, said cap having an upper surface and said closure having a lower surface, a pedestal formed with the cap and protruding upward above the upper surface thereof, said surface otherwise lying in a single plane, said hinge extending along one edge of the pedestal, the lower surface of said closure lying flat against the upper surface of the cap when said closure is shut.

2. The invention recited in claim 1, further comprising a plurality of plugs extending downwardly from the bottom surface of said closure for sealing said holes when the closure is shut.

3. The invention recited in claim 2, wherein each plug has a tip and a tang formed on said tip, said tang being constructed to pass through its respective hole when the closure is forced shut, and subsequently to retain the plug within its hole.

4. The invention recited in claim 2, further comprising a conical base portion for each plug between the closure and the distal tip of the plug.

* * * * *